US009809868B2

(12) United States Patent
Wu et al.

(10) Patent No.: US 9,809,868 B2
(45) Date of Patent: Nov. 7, 2017

(54) STRAIGHT BARREL TYPE VACUUM REFINING DEVICE AND METHOD FOR USE THE SAME

(71) Applicants: MAGANG (GROUP) HOLDING CO. LTD., Maanshan, Anhui (CN); MAANSHAN IRON & STEEL CO. LTD., Maanshan, Anhui (CN)

(72) Inventors: Liping Wu, Anhui (CN); Chang Shen, Anhui (CN); Yuchang Hu, Anhui (CN); Yuanwang Pan, Anhui (CN); Shaomin Pu, Anhui (CN); Yong Wang, Anhui (CN); Yangguo Xie, Anhui (CN)

(73) Assignees: MAGANG (GROUP) HOLDING CO. LTD., Maanshan, Anhui (CN); MAANSHAN IRON & STEEL CO. LTD., Maanshan, Anhui (CN)

( * ) Notice: Subject to any disclaimer, the term of this patent is extended or adjusted under 35 U.S.C. 154(b) by 246 days.

(21) Appl. No.: 14/422,929

(22) PCT Filed: Aug. 20, 2013

(86) PCT No.: PCT/CN2013/081890
§ 371 (c)(1),
(2) Date: Feb. 20, 2015

(87) PCT Pub. No.: WO2014/029325
PCT Pub. Date: Feb. 27, 2014

(65) Prior Publication Data

US 2015/0240323 A1 Aug. 27, 2015

(30) Foreign Application Priority Data

Aug. 24, 2012 (CN) ..... 2012 1 0302397

(51) Int. Cl.
*C21C 1/00* (2006.01)
*C21C 7/10* (2006.01)
(Continued)

(52) U.S. Cl.
CPC ..... *C21C 7/10* (2013.01); *C21C 7/064* (2013.01); *C21C 7/068* (2013.01); *C21C 7/072* (2013.01)

(58) Field of Classification Search
CPC ..... C21C 7/10
(Continued)

(56) References Cited

U.S. PATENT DOCUMENTS 5,603,749 A * 2/1997 Stelts ..... C21C 7/10 266/211

FOREIGN PATENT DOCUMENTS

CN 2432219 Y 5/2001
CN 101302571 A 11/2008
(Continued)

*Primary Examiner* — Scott Kastler
(74) *Attorney, Agent, or Firm* — Novick, Kim & Lee, PLLC; Allen Xue

(57) ABSTRACT

Provided is a straight barrel type vacuum refining device comprising a vacuum chamber and a snorkel; during the vacuum refining the snorkel is inserted into the molten steel of the steel ladle, it is characterized in that, disposing a circulating tube being on the circumference of said snorkel, and blowing argon gas into the snorkel through the nozzles on an inner wall of a circulating tube; said circulating tubes are disposed in layers, the nozzles on the circulating tubes in the same layer are individually controlled as 2-6 in one group; disposing an eccentric gas permeable brick at the bottom of said steel ladle, and blowing argon gas into the steel ladle through the eccentric gas permeable brick, driving a circulating flow molten steel between the steel ladle and the vacuum chamber by using different blowing flow rate
(Continued)

combinations of a steel ladle bottom blowing and each individually controlled unit of the circulating tube blowing system.

6 Claims, 3 Drawing Sheets

(51) Int. Cl.
*C21C 7/064* (2006.01)
*C21C 7/068* (2006.01)
*C21C 7/072* (2006.01)

(58) Field of Classification Search
USPC ..... 266/211
See application file for complete search history.

(56) References Cited

FOREIGN PATENT DOCUMENTS

| | | | |
|---|---|---|---|
| CN | 101701279 | B | 4/2011 |
| CN | 101792845 | B | 10/2012 |
| CN | 102816896 | A | 12/2012 |
| CN | 202830077 | U | 3/2013 |
| JP | H0649528 | A | 2/1994 |
| JP | H0741834 | A | 2/1995 |
| JP | H0754034 | A | 2/1995 |

* cited by examiner

STRAIGHT BARREL TYPE VACUUM REFINING DEVICE AND METHOD FOR USE THE SAME

TECHNICAL FIELD

The present invention belongs to the field of molten steel external refining, specifically it relates to a vacuum refining device concurrently producing an ultra-low carbon, ultra-low sulfur steel.

BACKGROUND OF THE INVENTION

Current external refining methods for industrial scale production of ultra-low carbon, ultra-low sulfur steel mainly adopt a RH vacuum refining. The main problems of the process for producing the ultra-low carbon, ultra-low sulfur steel by using the RH vacuum refining are following:

First, a decarburization velocity of the RH vacuum refining is low, because in case of the same molten steel active oxygen, carbon content and vacuum degree, the reaction velocity of the vacuum decarburization mainly depends on a circulating flow rate of a molten steel, and there is a 1.5 order relationship between the molten steel circulating flow rate and a inner diameter of a snorkel. Because a RH furnace consists of two upward and downward snorkels, the inner diameter of the snorkel is smaller, the decarburization velocity is restricted by an inner diameter of the snorkel and it is difficult to be improved by a process optimization.

Second, a desulfurization rate of the RH furnace vacuum refining process is low and unstable, and a desulfurizer severely corrodes the snorkel and a refractory material of a lower part slot in a vacuum chamber. The reason is the desulfurization in the RH furnace vacuum process is primarily to disperse the desulfurizer within the molten steel by using a circulating motion of the added desulfurizer with the molten steel, forming a reaction interface to achieve the purpose of the desulfurization. This requires that 1) the addition of the desulfurizer is primarily by mixing and injecting a gas and powder two-phase steam into a molten pool of the vacuum chamber, to facilitate dispersion of the desulfurizer within the molten steel; 2) the desulfurizer must be a mixture with high sulfur melting quantity and low melting point (it is the commonly used mixture containing 30% $CaF_2$ and 70% CaO); 3) a circulating flow rate of the molten steel is sufficiently high, to ensure more molten steel entering into the vacuum chamber and contacting with the desulfurizer particles over the same powder injection time, improving the desulfurization efficiency. In view of this, the desulfurization in the RH vacuum process has the following inherent defects: 1) because a desulfurization rate depends on a dispersion degree of the desulfurizer within the molten steel, the desulfurization rate is unstable; 2) the desulfurization rate is highly effected by the circulating flow rate of the molten steel, the circulating flow rate of the molten steel under the two snorkel conditions of RH is small, thus the desulfurization rate is not high; 3) because the desulfurizer contains up to 30% of $CaF_2$, it severely corrodes the vacuum chamber and the refractory material of the snorkel, shortening its service life.

To date what have been disclosed in China are Chinese Patent Number ZL00235854.9 "Multi-function combined blown single nozzle refining furnace", Chinese Patent CN101701279B "A method for smelting low-sulfur steel by a single nozzle refining furnace" and Chinese Patent CN101792845B "A method for smelting ultra-low carbon steel by a single nozzle refining furnace", these patents improve the circulating flow rate of the molten steel in the vacuum refining process by increasing a cross-sectional area of the snorkel, so as to improve a decarburization efficiency. However, in order to ensure that an exposed face of the molten steel in the vacuum chamber being sufficiently large to improve a decarburization reaction velocity, these patents all require discharging a steel ladle slag from the snorkel before the snorkel is inserted into the molten steel, increasing the exposed face of the molten steel, and improving the reaction velocity of the decarburization. Meanwhile, the desulfurizer injected during the desulfurization can effectively disperse within the molten steel, thereby increasing the reaction interface and improving the desulfurization efficiency. Accordingly, these patents have strict requirement on a tapping slag quantity in a converter (or electric furnace) tapping process. If a surface slag layer of the molten steel is thick, then a slag discharge operation before insertion of the snorkel into the molten steel is difficult to conduct. These patents are same as the RH vacuum refining in terms of desulfurization principle of the vacuum process, thus it is necessary to select a desulfurizer with high $CaF_2$ content (generally 30%) which is same as the sulfurization in the RH vacuum refining process, the desulfurizer severely corrodes the snorkel and the refractory material of the lower part slot in the vacuum chamber, decreasing the service life of the snorkel and the lower part slot in the vacuum chamber. The single nozzle refining furnaces which have been disclosed to date all use steel ladle bottom blowing as a driving force for a circulating flow of the molten steel in the vacuum process, and when a clogging occurs in the gas permeable brick at the bottom of the steel ladle, the vacuum refining will be unable to conduct, resulting in production interruption.

Chinese Patent CN101302571A discloses a single nozzle refining furnace, at least of a set of traveling magnetic field generators disposed on a periphery of its suction nozzle is merely used for increase the flow velocity of the molten steel, improving the circulating flow rate of the molten steel. It is unable to resolve the problem of steel ladle top slag layer covering the molten steel face and resulting in decreased expose face of the molten steel, and decreasing the decarburization and desulfurization efficiency. Also, in Chinese Patent CN101302571A, the traveling magnetic field generators on the snorkel can accelerate the flow velocity of the molten steel only at the time of circulating flow, once the steel ladle bottom blowing is clogged and the molten steel is in motionless state, the traveling magnetic field generators will be out of action, and the vacuum refining is unable to be conducted, resulting in production interruption.

SUMMARY OF THE INVENTION

In order to resolve the problems existing in the prior art, the object of the present invention is to provide a straight barrel type vacuum refining device. The first object is to resolve the problem of the single nozzle refining furnace of prior art such as: in order to ensure the decarburization and desulfurization effect, it is required to conduct the slag discharge before the snorkel is inserted into the molten steel to avoid the steel ladle top slag entering into the vacuum chamber as far as possible, therefore it is required that the steel ladle molten steel surface slag layer should be thin as far as possible, that is, it is required that the quantity of slag in tapping process is small as far as possible or even no slag. The second object is to resolve the problem such as the single nozzle refining furnace and RH of prior art can only select a desulfurizer of high fluorine content (30% $CaF_2$), resulting in severe corrosion of the snorkel and the refractory material of the lower part slot in the vacuum chamber by the desulfurizer, greatly shortening its service life. The third object is to resolve the problem of the single nozzle refining furnace of the prior art such as: when the steel ladle bottom blowing element is clogged, the whole vacuum refining process is unable to be conducted, resulting in production interruption.

To resolve the above-described technical problems, the present invention provides a straight barrel type vacuum refining device comprising a vacuum chamber and a snorkel; during the vacuum refining the snorkel is inserted into a molten steel of the steel ladle. It is characterized in that, disposed a circulating tube at a circumference of said snorkel, and blowing argon gas into the snorkel through nozzles on the inner wall of the circulating tube; said circulating tube are disposed in layers, the circulating tube in the same layer are controlled individually; disposing an eccentric gas permeable brick at the bottom of said steel ladle, and blowing argon gas into the steel ladle through the eccentric gas permeable brick, and driving a circulating flow of the molten steel between the steel ladle and the vacuum chamber by using different combinations of the blowing flow rate of each individual control units of the steel ladle bottom blowing and a circulating tube blowing system.

A further improvement of the present invention is: said circulating tube are disposed in one layer, the nozzles on the circulating tube are distributed at equal central angle, and the central angle between the nozzles is 10°-30°; or, the nozzles on the circulating tube are distributed at equal distance, and the number of the nozzles is 8-30.

A further improvement of the present invention is: said circulating tube are disposed in two layers, the nozzles on each of the circulating tube are distributed at equal distance, and the number of the nozzles in each layer is 6-15, and the nozzles in upper and lower layers are cross arranged.

A further improvement of the present invention is: said circulating tube are disposed in three layers, the nozzles on each of the circulating tube are distributed at equal distance, the number of the nozzles in each layer is 6-12, the nozzles in adjacent layers are cross arranged; the nozzles in the same layer are controlled individually in a group of 2-6; each layer is distributed at equal distance, and the distance is 150 mm-400 mm.

A further improvement of the present invention is: the cross-sectional shape of said snorkel is roughly circular, and it consists of two pars of a large circular arc face and a small circular arc face, the radius of curvature of the large circular arc face is same as the vacuum chamber, and the radius of curvature of the small circular arc face is greater than the vacuum chamber, and the ratio of the radius of curvature of the large circular arc face and the small circular arc face is 1:1-∞.

The present invention also provides a refining method of said straight barrel type vacuum refining device, wherein the vacuum refining process uses the steel ladle bottom eccentric gas permeable brick and a snorkel circulating tube combined blown mode; during decarburization, the bottom blowing and the circulating tube at the same side of the bottom blowing are strong blowing, and the circulating tube on the other side is weak blowing; during desulfurization, the bottom blowing is strong blowing, the circulating tubes around the snorkel are all weak blowing; in later period of the refining, the circulating tube gas quantity and bottom blowing quantity are adjusted to small; and a molten steel clean circulation is controlled and the vacuum chamber surface slag is not involved, and the inclusions in the steel is promoted to collide and float and absorbed by the surface slag.

The present invention also provides a refining method of said straight barrel type vacuum refining device when the steel ladle bottom blowing is clogged or the steel ladle bottom blowing is closed as the smelting requirement:

(1) during decarburization, one side of the circulating tube uses large quantity blowing, the corresponding other side uses small quantity blowing, these two semi-circumference regions form an ascending pipe and a descending pipe similar to RH, achieving the molten steel rising on the side of the strong blowing, and declining on the side of the weak blowing, driving the circulating flow the molten steel in the vacuum chamber and the steel ladle, and because one side is strong blowing and the other side is weak blowing, the steel ladle slag on the vacuum chamber molten steel face may be compressed to the region of the weak blowing, ensuring the exposed face of the molten steel in the vacuum chamber is sufficiently large to achieve the purpose of rapid deep decarburization;

(2) During desulfurization, the nozzles are all strong blowing, driving the molten steel rising around the snorkel, and declining from a central region, and achieve deep desulfurization of the molten steel by complete mixing of the steel ladle residue and the molten steel under the vacuum condition;

(3) in later period of the refining, altering the circulating tube blowing quantity to slightly greater at one side and very small at the other side, controlling the molten steel circulation not to be involved in the vacuum chamber surface slag, and promoting the inclusions in the steel to collide and float and absorbed by the surface slag.

The design idea of the present invention is:

According to the present invention, a single straight barrel type snorkel is coupled to the lower part of the vacuum chamber, the inner diameter of the snorkel is same as the inner diameter of the vacuum chamber, and single layer or multi-layer of circulating tubes are cross arranged in the circumference of the inner wall of the circulating tube, and the gas permeable brick are arranged at an eccentric position at the bottom of the steel ladle. The nozzles as 2-6 in a group are disposed on the circulating tube, i the injection flow rate are individually controlled. In the vacuum refining process, driving the circulating flow of the molten steel between the steel ladle and the vacuum chamber by using the steel ladle bottom blowing and circulating tube top blowing, and controlling the vacuum chamber molten steel face top slag state according to the main tasks of different stages of the vacuum refining process (decarburization, desulfurization etc.) by the steel ladle bottom blowing and different blowing combination controlled by each individual control unit on the circulating tube.

Using the straight barrel type vacuum refining device according to the present invention, it is unnecessary to discharge the molten steel surface slag from the snorkel, on the contrary the decarburization, desulfurization and inclusion removal may be conducted by fully using the molten steel surface slag entering into the vacuum chamber. Its refining method is: (1) increasing the exposed area of the vacuum chamber molten steel to achieve rapid deep decarburization by different combinations of the individually controlled blowing system on the circulating tube and the bottom blowing, and further conducting the deep decarburization by using the oxygen in the high oxidative slag on the molten steel face; (2) during desulfurization, the bottom blowing is strong blowing, the circulating tubes around the snorkel are all weak blowing, this can effectively increase slag-metal reaction area and improve the desulfurization effect, and the circulating tube weak blowing gas around the snorkel can form a gas isolation area between the steel slag in the vacuum chamber and the inner wall of the vacuum chamber, decreasing the corrosion of steel slag to the refractory material, and increasing the service time of the refractory material; (3) at later period of the refining, adjusting the circulating tube gas quantity and bottom blowing quantity to small, and controlling the molten steel clean circulation not to be involved in the vacuum chamber surface slag, and promoting the inclusions in the steel to collide and float and to be absorbed by the surface slag.

By using the straight barrel type vacuum refining device according to the present invention, when a clogging occurs in the steel ladle bottom blowing or the steel ladle bottom blowing is closed according to the smelting requirement, the vacuum decarburization and desulfurization can still be normally conducted, not resulting in production interruption. Its principle is that, in the present invention, the nozzles arranged on the circulating tube use a manner of individually controlling flow rate in different regions. Its refining method is: (1) during decarburization, at one side of the circulating tube a large quantity lowing is adopted, at the corresponding the other side a small quantity blowing is adopted, these two semi-circumference regions form the ascending pipe and the descending pipe similar to RH, achieving the molten steel rising at the side of the strong blowing, and declining at the side of the weak blowing, driving the circulating flow of the molten steel in the vacuum chamber and the steel ladle, and because one side is strong blowing and the other side is weak blowing, the steel ladle slag on the vacuum chamber molten steel surface may be compressed to the region on the weak blowing side, ensuring the exposed face of the molten steel in the vacuum chamber being sufficiently large to achieve the purpose of rapid deep decarburization; (2) during desulfurization, the nozzles are all strong blowing, driving the molten steel rising around the snorkel, and declining from the central region, and achieving the molten steel deep desulfurization by complete mixing of the steel ladle slag and the molten steel under the vacuum condition; (3) at later period of the refining, the circulating tube blowing quantity is altered to slightly larger on one side and the other side is very small, controlling the vacuum chamber surface slag not to be involved in the molten steel circulation, and promoting the inclusions in the steel to collide and float and to be absorbed by the surface slag.

Compared with the prior art, the present invention provides a straight barrel type vacuum refining device. Its first object is to resolve the problem such as: in the single nozzle refining furnace disclosed in the existing patents, in order to ensure the decarburization and desulfurization effect, it is required to conduct the slag discharge before the snorkel is inserted into the molten steel to avoid the entry of the steel ladle top slag into the vacuum chamber as far as possible, thus it is required the steel ladle molten steel surface slag layer is thin as far as possible, that is it is required the quantity of slag in the tapping process is small as far as possible. The present invention controls the slag state on the vacuum chamber molten steel face by the individually controlled nozzles of the circulating tube disposed at the circumference of the snorkel, by different blowing combination according to different stages in the vacuum refining process, that is, by adjusting the blowing flow rate of the controlled nozzles on the circulating tube, during decarburization blowing the steel ladle slag toward one side or toward the center, sufficiently exposing the molten steel face, and fully using the oxygen in the high oxidative slag on the molten steel surface for further deep decarburization, during desulfurization by adding a certain quantity of lime and aluminum particle (or premelted refining slag) and reacting with the top slag on the vacuum chamber molten steel face to form a calcium aluminum type desulfurization slag, allowing the molten steel in the vacuum chamber to contact and react with the top slag, to carry out the deep desulfurization under vacuum. Accordingly, the present invention has no requirement on the thickness of the steel ladle top slag, and also covering the molten steel surface slag into the snorkel before the snorkel is inserted into the molten steel, fully using the top slag for the deep decarburization and deep desulfurization. The second object is to resolve the problem such as the single nozzle refining furnace and RH disclosed in the existing patens can only select a desulfurizer of high fluorine content (30% $CaF_2$), resulting in the desulfurizer severely corroding the snorkel and the refractory material in the vacuum chamber lower part slot, and greatly shortening its service life. The third object is to resolve the problem such as, in the single nozzle refining furnace disclosed in the existing patents, when the steel ladle bottom blowing elements is clogged, the entire vacuum refining process cannot be conducted, resulting production interruption.

BRIEF DESCRIPTION OF THE DRAWINGS

The present invention will be explained below in detail in conjunction with the attached drawings:

In FIG. 1, 1—top lance, 2—vacuum extraction system, 4—feeding device, 5—vacuum chamber, 6—connecting flange, 7—snorkel, 8—circulating tube, 9—steel ladle, 10—eccentric bottom blowing argon gas permeable brick of the steel ladle, 11—steel ladle vehicle; 101—an imaginary center line that passes horizontally through the center of the straight barrel type vacuum refining device In FIG. 2: 13—snorkel large circular arc face, 15—snorkel small circular arc face; 102—an imaginary center line that passes horizontally through the center of the A-A cross-sectional view; 103—an imaginary center line that passes vertically through the center of the A-A cross-sectional view;

In FIG. 3: 12—temperature measuring sampling point of the steel ladle; 104—an imaginary center line that passes horizonatally through the center of the B-B cross-sectional view; 105—an imaginary center line that passes vertically through the center of the B-B cross-sectional view.

DETAILED DESCRIPTION OF EMBODIMENTS

EXAMPLE 1

Figure 1:
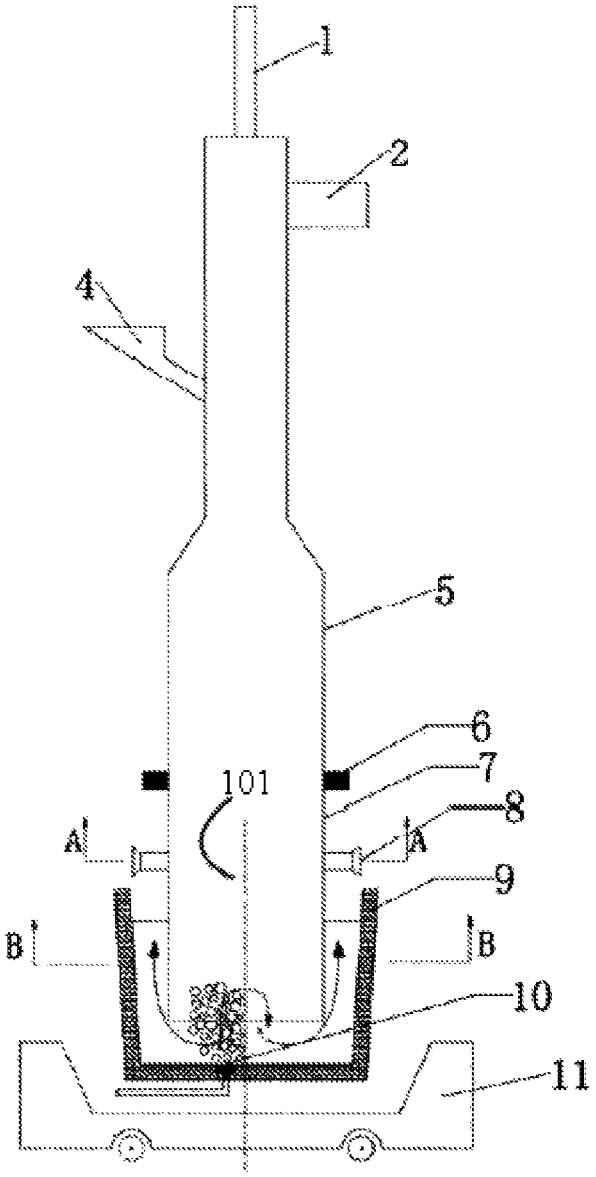
FIG. 1 is a structural schematic diagram of a straight barrel type vacuum refining device.
Figure 2:
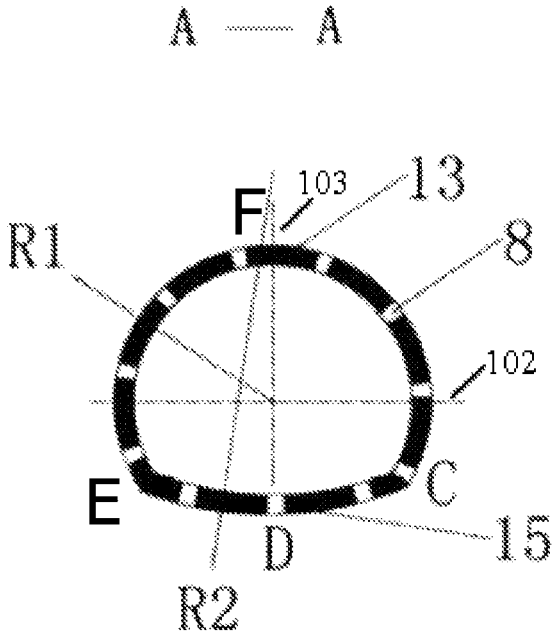
FIG. 2 is an A-A cross-sectional view of FIG. 1.
Figure 3:
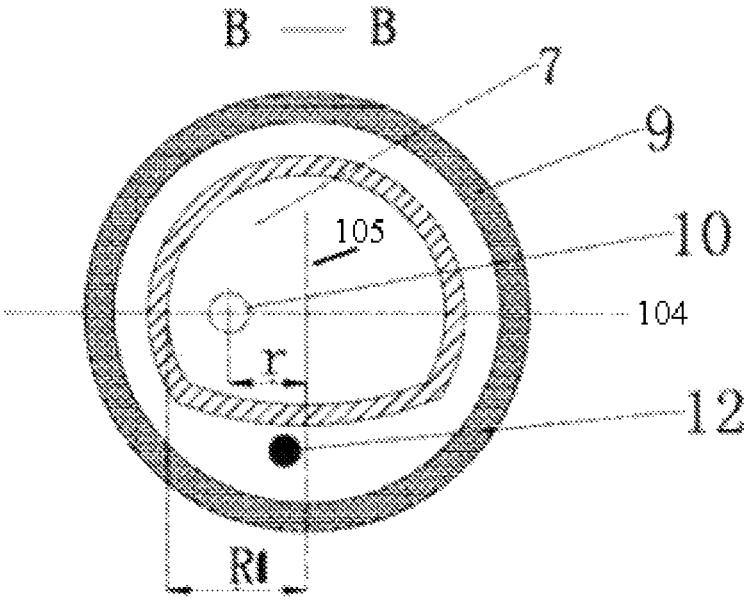
FIG. 3 is a B-B cross-sectional view of FIG. 1.

As can be seen in FIG. 1, FIG. 2, and FIG. 3, the straight barrel type vacuum refining device mainly consists of a vacuum chamber 5, a snorkel 7, a steel ladle 9 and a steel ladle vehicle 11, the vacuum chamber and snorkel was connected by a flange 6, the snorkel was located directly above the steel ladle, the steel ladle was place on the steel ladle vehicle. A circulating tube 8 is disposed around the snorkel, and it may be used in blowing a inert gas into the molten steel to achieve multiple functions, the circulating tube was located in the upper part of the snorkel, and one layer of circulating tube were disposed in a direction perpendicular to the snorkel, the nozzles on the circulating tube were distributes at equal central angle, the central angle between the nozzles was 10°-30°; or, the nozzles on the circulating tube were distributed at equal distance, the number of the nozzles was 8-30. A bottom gas permeable brick 10 was disposed at the eccentric position of the steel ladle bottom, and argon gas entered into the molten steel through the gas permeable brick. During the molten steel refining, the steel ladle 9 was lifted to above the steel ladle vehicle 11, the steel ladle vehicle traveled to a processing working position, and the steel ladle was jacked to allow the snorkel 7 to be inserted into the molten steel, and vacuum extraction system 2 was activated to conduct a vacuum pumping, and argon gas was blown from the gas permeable brick 10, meanwhile the circulating tube 8 was activated to blow argon gas into the molten steel, and the flow rate and the pressure of the blown argon gas were adjusted as required, and the temperature measuring sampling mechanism 12 conducted a temperature measuring and sampling operation, when the composition and the temperature met the requirements, the vacuum was damaged, and the steel ladle was lowered to its original position, and the vacuum treatment refining process was finished.

EXAMPLE 2

As can be seen in FIG. 1, FIG. 2, and FIG. 3, the straight barrel type vacuum refining device mainly consisted of the vacuum chamber 5, the snorkel 7, the steel ladle 9 and the steel ladle vehicle 11, the vacuum chamber and the snorkel are connected by the flange 6, the snorkel was located directly above the steel ladle, and the steel ladle was placed on the steel ladle vehicle. The feeding device 4 was disposed in the upper part of the vacuum chamber and it may add material, the vacuum pumping system 2 was responsible for the vacuum pumping, and the top lance 1 can blow oxygen. The circulating tube 8 was disposed around the snorkel, and it was used in blowing the inert gas into the molten steel to achieve multiple functions, the circulating tube was located in the upper part of the snorkel, in order to improve the deoxidation and desulfurization efficiency, two layers of circulating tubes were disposed in the direction perpendicular to the snorkel, the nozzles on each circulating tube were distributed at equal distance, the number of the nozzles in each layer was 6-15, and the nozzles in upper and lower layers were cross arranged. Three layers of the circulating tubes may also be disposed in the direction perpendicular to the snorkel, the nozzles on each of circulating tube were distributed at equal distance, the number of the nozzles in each layer was 6-12, the nozzles in adjacent layers were cross arranged; each layers were distributed at equal distance, and the distance was 150 mm-400 mm. The distance from the lowest layer of said circulating tube to the bottom of the snorkel was 100 mm-500 mm. The bottom gas permeable brick 10 was disposed at an eccentric position in the steel ladle bottom, and argon gas entered into the molten steel through the gas permeable brick.

During molten steel refining, the steel ladle 9 was lifted to above the steel ladle vehicle 11, the steel ladle vehicle traveled to the working position, the steel ladle was jacked to allow the snorkel 7 to be inserted into the molten steel, and the vacuum extraction system 2 was opened to conduct the vacuum pumping, and argon gas was blown into from the gas permeable brick 10, meanwhile the argon gas was blown into the molten steel by the circulating tube 8, and the flow rate and the pressure of the blown argon gas was adjusted as required, the temperature measuring and sampling mechanism 12 conducted the temperature measuring and sampling operation, in the refining process, the required alloy or residue was added by the feeding device 4 according to the steel type requirement, when the composition and the temperature met the requirements, the vacuum was damaged, and the steel ladle was lowered to the original position, and the vacuum treatment refining process was finished.

EXAMPLE 3

The other structures of the refining device was the same as Example 1 and 2, in order to further improve the decarburization efficiency, the nozzles as 2-6 in one group on the circulating tube were individually controlled.

During the molten steel refining, the steel ladle 9 was lifted to above the steel ladle vehicle 11, the steel ladle vehicle traveled to the working position, and the steel ladle was jacked to allow the snorkel 7 to be inserted into the molten steel, and the vacuum extraction system 2 was activated to conduct vacuum pumping, and argon gas was blown into from the gas permeable brick 10, meanwhile the circulating tube 8 was activated to blow argon gas into the molten steel, the flow rate and the pressure of the blown argon gas was adjusted as required, during decarburization the bottom blowing and the circulating tube on the same side as the bottom blowing were strong blowing, the circulating tube on the other side was weak blowing; during desulfurization, the bottom blowing was strong blowing, the circulating tube around the snorkel were all weak blowing; the temperature measuring and sampling mechanism 12 conducted the temperature measuring and sampling operation, in the refining process the required alloy or residue were fed in by the feeding device 4 according to the steel type requirement, when the composition and the temperature reached the requirements, the vacuum was damaged, and the steel ladle was lowered to its original position, the vacuum treatment refining process was finished.

EXAMPLE 4

The other structures of the refining device was the same as Example 1 or 2 or 3, in order to facilitate the temperature measuring and sampling operation in the refining process, the cross-sectional shape of said snorkel was roughly circular, it consisted of the large circular arc 13 (arc EFC) and the small circular arc 15 (arc EDC), the radius R1 of the large circular arc was the same as the vacuum chamber, the radius R2 of the small circular arc was greater than the vacuum chamber, the ratio of the radius of the large circular arc and the small circular arc was 1:1-00. The ratio of the distance r from the gas permeable brick 10 to the large circular arc 13 with the radius R1 of the large circular arc was 0.2-0.7.

During molten steel refining, the steel ladle 9 was lifted to above the steel ladle vehicle 11, the steel ladle vehicle traveled to the processing working position, and the steel ladle was jacked to allow the snorkel 7 to be inserted into the molten steel, and the vacuum extraction system 2 was activated to conduct the vacuum pumping, and argon gas was blown from the gas permeable brick 10, meanwhile the circulating tube 8 was activated and argon gas was blown into the molten steel, the flow rate and the pressure of the blown argon gas were adjusted as required, during decarburization, the bottom blowing and the circulating tube on the same side of the bottom blowing were strong blowing, and the circulating tube on the other side was weak blowing;

during desulfurization, the bottom blowing was strong blowing, and the circulating tubes around the snorkel were all weak blowing; the temperature measuring and sampling mechanism 12 conducted the temperature measuring and sampling operation, in the refining process the required alloy or residue was added by the feeding device 4 according to the steel type requirement, when the composition and the temperature met the requirements, the vacuum was damaged, and the steel ladle was lowered to its original position, and the vacuum treatment refining process was finished.

EXAMPLE 5

The refining method at the time of the eccentric gas permeable brick in the steel ladle bottom was clogged or the steel ladle bottom blowing was closed according to the smelting requirement:

(1) during molten steel refining, the steel ladle 9 was lifted to above the steel ladle vehicle 11, and the steel ladle vehicle traveled to the processing working position of the straight barrel type vacuum refining device, the blowing quantity of the snorkel and the circulating tubes individually controlled in 3 groups in the semi-circumference regions on the same side as the steel ladle bottom blowing were same, the total blowing flow rate was controlled to ton steel 13 NL/min, the blowing quantity of the flow rate individually controlled circulating tubes in 3 groups in the semi-circular region on the opposite side were the same, the total blowing flow rate of the circulating tubes was controlled to ton steel 7 NL/min;

(2) the snorkel was inserted into the molten steel, and the snorkel was inserted for depth of 400 mm, meanwhile the vacuum pumping made the vacuum degree after 3 minutes to be reduced for 73 Pa. The vacuum chamber molten steel face top slag was observed by a vacuum chamber photograph, and the total blowing flow rate of the circulating tubes on the same side as the steel ladle bottom blowing on the snorkel was further adjusted to ton steel 18 NL/min;

(3) after 10 minutes of the decarburization, the blowing quantity of all the flow rate individually controlled circulating tubes on the snorkel were all adjusted to the same, the total flow rate was controlled to ton steel 28 Nl/min;

(4) after 15 minutes of the decarburization, a deoxidizer of aluminum particle was added at 2.4 kg/t steel by the feeding device 4, after 3 minutes, an oxygen determination was conducted at the sampling position 12, the active oxygen of the molten steel was 0.32 ppm. A lime of 6.08 kg/t steel was blown by the lance;

(5) after 6 minutes of blowing of the lime, the blowing flow rate of the circulating tube on the snorkel was adjusted to small, the blowing quantity of the flow rate individually controlled circulating tubes in 3 groups in semi-circumference region on the same side of the steel ladle bottom blowing were same, the total blowing flow rate was adjusted to ton steel 15 NL/min, the blowing quantity of the flow rate individually controlled circulating tubes in 3 groups in the semi-circumference region on the opposite side were the same, the total blowing flow rate of the circulating tubes was adjusted to ton steel 5 NL/min, after 6 minutes of circle the molten steel, the steel ladle bottom blowing was closed, the vacuum was damage, and the sampling and temperature measuring was conducted at the sampling position 12.

Implementation Effect:

In a certain steel plant, a combination blowing refining test of 86 furnaces steel ladle bottom blowing and the circulating tube on the snorkel as well as 23 furnaces snorkel circulating tube blowing refining test, and the test results were as follow.

The combination test results of 86 furnaced steel ladle steel ladle bottom blowing and the circulating tube on the snorkel were: the active oxygen of the starting molten steel before entering into the straight barrel type vacuum refining device (a[O]) was between 0.0459-0.0823%, the average was 0.0589%, the [C] was between 0.025-0.050%, the average was 0.032%, the [S] was between 0.004-0.009%, the average was 0.0069%, in the 30-45 minutes (the average was 39 minutes) of refining cycle of the straight barrel type vacuum refining device, the ton steel lime addition quantity was 3-8 kg/t−1, the average was 5.32 kg/t−1, the ton steel aluminum particle feed quantity was 0.8-3.1 kg/t−1, the average was 1.78 kg/t−1, the molten steel [C] at endpoint of the vacuum refining was between 0.0005-0.0011%, the average was 0.0008%; the molten steel [S] content was 0.0008-0.0021%, the average was 0.0013%, the desulfurization rate was 73-87%, the average desulfurization rate reached to 81.1%.

The circulating tube blowing test results of 23 furnaces on the snorkel were: the starting active oxygen (a[O]) in the molten steel before entering the straight barrel type vacuum refining device was between 0.0572-0.0792%, the average was 0.0578%, the [C] was between 0.023-0.048%, the average was 0.031%, the [S] was between 0.005-0.008%, the average was 0.0062%, during 30-45 minutes (the average was 42 minutes) of the refining circle of the straight barrel type vacuum refining device, ton steel lime addition quantity was 3-8 kg/t−1, the average was 5.64 kg/t−1, the ton steel aluminum particle addition quantity being 1.1-3.2 kg/t−1, the average was 1.92 kg/t−1, the molten steel [C] at endpoint of the vacuum refining was between 0.0007-0.0013%, the average was 0.0009%; the molten steel [S] content was 0.0007-0.0025%, the average was 0.0014%, the desulfurization rate was 69-82%, the average desulfurization rate reached to 75.2%.

The invention claimed is:

1. A method of operating a vacuum refining device, wherein the vacuum refining device comprises:

a vacuum chamber;

a snorkel connected to the vacuum chamber, wherein the snorkel is tubular in shape;

a steel ladle adapted to hold molten steel during vacuum refining, wherein the snorkel is adapted to be inserted into the molten steel in a steel ladle during vacuum refining;

a first circulating tube disposed about an inner circumference of said snorkel and adapted to blow a first argon gas into the molten steel through a plurality of nozzles disposed thereon, wherein a flow rate of the first argon gas in each of the plurality of nozzles on the circulating tube is individually controllable, a gas permeable brick eccentrically placed in a bottom of the steel ladle, wherein, during vacuum refining, a second argon gas blows into the steel ladle through the gas permeable brick to circulate the molten steel between the steel ladle and the vacuum chamber, the method comprising:

inserting the snorkel into the molten steel in the steel ladle;

blowing a first argon gas into the molten steel through the circulating tubes through the plurality of nozzles disposed thereon;

blowing a second argon gas into the molten steel through the gas permeable brick in the bottom of the steel ladle, wherein, during decarburization, the blowing through the gas permeable brick and the blowing through the circulating tubes on the same side as the gas permeable brick is strong blowing, the blowing through circulating tube on the other side is weak blowing;

during desulfurization, the bottom blowing through the gas permeable brick is strong blowing, and the blowing through circulating tube around the snorkel is weak blowing; and after decarburization and desulfurization, lowering the flow rate of the first argon gas through the circulating tubes and the flow rate of the second argon gas through the gas permeable brick.

2. A method of operating a vacuum refining device, wherein the vacuum refining device comprises:

a vacuum chamber;

a snorkel connected to the vacuum chamber, wherein the snorkel is tubular in shape;

a steel ladle adapted to hold molten steel during vacuum refining, wherein the snorkel is adapted to be inserted into the molten steel in a steel ladle during vacuum refining;

a first circulating tube disposed about an inner circumference of said snorkel and adapted to blow a first argon gas into the molten steel through a plurality of nozzles disposed thereon, wherein a flow rate of the first argon gas in each of the plurality of nozzles on the circulating tube is individually controllable, a gas permeable brick eccentrically placed in a bottom of the steel ladle, wherein, during vacuum refining, a second argon gas blows into the steel ladle through the gas permeable brick to circulate the molten steel between the steel ladle and the vacuum chamber, the method comprising:

(1) decarburizing the molten steel by blowing a larger flow rate of the first gas through a first semicircle among two semicircles forming each circulating tube and a smaller flow rate of the first gas through the second semicircle among the two semicircles forming each circulating tube to circulate the molten steel in the steel ladle so that slags on a surface of the molten steel concentrated in one area on a surface of the molten steel;

(2) desulfurizing the molten steel by blowing the first gas through all the nozzles in the circulating tube so that the slags are mixed with the molten steel under vacuum; and (3) increasing the flow rate of the first argon gas through the first semicircle and reducing the flow rate of the first argon gas through the second semicircle.

3. The method according to claim 1, wherein, in the vacuum refining device, a distance between an outer diameter of said snorkel and an inner diameter of said steel ladle is 100 mm-400 mm.

4. The method according to claim 1, wherein, in the vacuum refining device, a cross section of the outer wall of the snorkel consists of a longer circular arc and a shorter circular arc connected together, wherein the longer circular has a radius that is the same as a radius of the vacuum chamber, and the shorter circular arc has a radius that is greater than the radius of vacuum chamber.

5. The method according to claim 2, wherein, in the vacuum refining device, a distance between an outer diameter of said snorkel and an inner diameter of said steel ladle is 100 mm-400 mm.

6. The method according to claim 2, wherein, in the vacuum refining device, a cross section of the outer wall of the snorkel consists of a longer circular arc and a shorter circular arc connected together, wherein the longer circular has a radius that is the same as a radius of the vacuum chamber, and the shorter circular arc has a radius that is greater than the radius of vacuum chamber.

* * * * *